United States Patent [19]

Mitchell

[11] 3,993,147

[45] Nov. 23, 1976

[54] TAPER LOCK REMOVABLE STEM FOR RAISE BIT

[75] Inventor: Howard E. Mitchell, Duncanville, Tex.

[73] Assignee: Dresser Industries, Inc., Dallas, Tex.

[22] Filed: Jan. 19, 1976

[21] Appl. No.: 650,394

[52] U.S. Cl. ..... 175/344; 175/53

[51] Int. Cl.[2] ..... E21B 9/24; E21C 23/00

[58] Field of Search ..... 175/53, 344–347, 175/385–392, 412, 406, 407; 403/356, 367, 368, 370, 373, 374, 375

[56] References Cited

UNITED STATES PATENTS

| | | | |
|---|---|---|---|
| 1,472,565 | 10/1923 | Manning | 403/370 X |
| 1,941,217 | 12/1933 | McKinless, Jr. | 175/383 |
| 1,944,076 | 1/1934 | Giesey | 175/345 |
| 2,034,074 | 3/1936 | Wright | 175/392 X |
| 2,446,795 | 8/1948 | Trimble | 403/374 X |
| 2,739,791 | 3/1956 | Dimitrieff | 175/407 |
| 2,759,705 | 8/1956 | Bjorkman | 175/389 |
| 3,750,767 | 8/1973 | Pessier | 175/53 |
| 3,866,698 | 2/1975 | Stanley | 175/53 |
| 3,917,009 | 11/1975 | Dyer et al. | 175/334 X |
| 3,920,089 | 11/1975 | Mitchell | 175/53 |

*Primary Examiner*—Ernest R. Purser
*Assistant Examiner*—Richard E. Favreau
*Attorney, Agent, or Firm*—Eddie E. Scott

[57] ABSTRACT

A raise bit for enlarging a pilot hole into a larger diameter hole by disintegrating the earth formations that surround the pilot hole is provided with a removable drive stem. The removable drive stem allows the raise bit to be transported through small passages and helps extend the useful lifetime of the bit. The bit may be assembled without weakening the highly-stressed, heat-treated stem by welding. The raise bit body includes a multiplicity of rolling cutters for contacting and disintegrating the earth formations surrounding the pilot hole. A central opening extends through the bit body. The central opening includes an upward facing tapered surface. The lower end of the drive stem extends through the central opening. A downward facing tapered surface on the drive stem mates with the upward facing tapered surface on the bit body. The lower end of the drive stem is threaded to receive a threaded nut which draws the tapered surfaces together.

3 Claims, 2 Drawing Figures

TAPER LOCK REMOVABLE STEM FOR RAISE BIT

BACKGROUND OF THE INVENTION

The present invention relates to the art of earth boring and more particularly to a raise bit for enlarging a pilot hole into a larger diameter hole by disintegrating the earth formations surrounding the pilot hole.

A relatively large diameter hole may be provided between a first location and a second location by an operation commonly referred to as raise drilling. The raise drilling operation begins by drilling a small diameter pilot hole through the earth from a first location to an opening at a second location using a small diameter pilot bit. After the pilot hole is completed, the pilot bit is removed from the drill column and a larger diameter raise bit attached. The raise bit is rotated and drawn along the pilot hole thereby enlarging the pilot hole to the desired size.

On many occasions, the small diameter pilot hole extends to an area accessible only through a small drift or passage. The removable drive stem of the present invention provides the raise bit with a low profile thereby allowing the raise bit to be transported through low drifts or passages. For example, a 72-inch diameter raise bit may be transported through a drift having a 30-inch height whereas a 72-inch diameter raise bit without the removable stem requires a drift with at least a 52-inch height.

During the raise drilling operation, a tremendous amount of wear and stress is imposed upon the raise bit. Generally, the pilot hole tends to wander which results in a series of curves over the length of the pilot hole. As the raise bit is drawn along the pilot hole, the drilling geometry changes. This results in a tremendous amount of stress being transmitted to the raise bit when it is being drawn through the curves. The outside radius of the raise bit may be many times greater than the radius of the pilot hole; therefore, the moment developed is great. When resistance is encountered by cutters located on the outer radius of the raise bit as when drilling along a curve, it causes increased stress on the raise bit. It can be appreciated that changes in formations encountered during the raise drilling operation complicates the above-mentioned conditions and adds to the drilling difficulties.

The tremendous stress and wear encountered during the raise drilling operation causes some elements of the raise bit to wear out much earlier than others, notably the cutters and the drive stem. The bit of the present invention allows the elements that have a relatively short lifetime to be replaced thereby extending the lifetime of the bit and reducing cost. The drive stem is removable and, therefore, replaceable as are the individual cutters. This allows the elements that receive the greatest stress and wear to be readily replaced. The relatively short lifetime of the individual cutters results from their nearly constant contact with the formations and the consequent exposure to wear and abuse. The drive stem also contacts the formations and receives a great deal of wear and abuse. The drive stem absorbs a large amount of stress since it is the single link between the drill column and the body of the bit. All energy from the rotary equipment is transmitted to the bit through the drive stem.

The drive stem is often subject to failure prior to failure of the body of the raise bit. It is, therefore, desirable to be able to easily and quickly remove the stem from the raise bit and replace it with a new stem. The stem is generally constructed of a high-strength, heat-treated material and would be weakened by welding. It is, therefore, desirable to be able to attach and remove the stem from the raise bit body without welding. From the foregoing, it will be appreciated that the stem must be constructed of material that will stand up under the harsh conditions encountered. Such material is expensive and any reduction in the amount of this material used is cost savings. The bit of the present invention allows the stem to be manufactured from high-strength material, whereas the body may include lower strength and, therefore, less expensive materials.

The stem or a stabilizer section on the stem should be nearly the size of the pilot hole to insure a smooth raise drilling operation. In order to use the same bit body in pilot holes of different sizes, it is desirable to be able to remove the stem from the raise bit body and replace it with an appropriately sized stem. The stem should be easy to remove and replace using simple hand tools. This allows the stem to be replaced in the field under adverse conditions.

DESCRIPTION OF PRIOR ART

A general description of a raise drilling operation is presented in U.S. Pat. No. 3,220,494 to R. E. Cannon et al., patented Nov. 30, 1965. In the system disclosed in this patent, a pilot hole is enlarged to the desired raise hole size by rotating and drawing a large diameter raise bit upward along the pilot hole.

In U.S. Pat. No. 3,917,009 to Norman Dyer, et al., patented Nov. 4, 1975, a raise bit for enlarging a pilot hole is shown which includes a removable drive stem. The raise bit body includes a fixed collar with a truncated conical inside surface. A two-piece, split, removable collar with an inside surface that matches the outside surface of the drive stem and a conical outer surface that matches the inside surface of the fixed collar is positioned around the drive stem. A flange at the end of the drive stem allows the split collar to be drawn up in the fixed collar thereby developing frictional forces between the mating surfaces of the fixed collar, the split collar, and the drive stem. A preload is induced into the system to insure proper torque transmitting at low bit loads.

In U.S. Pat. No. 3,920,089 to Howard Mitchell, patented Nov. 18, 1975, a raise bit for enlarging a pilot hole into a larger diameter hole by disintegrating the earth formations surrounding the pilot hole is shown that includes a removable drive stem. The removability of the drive stem allows the raise bit to be transported through small drifts and extends the useful lifetime of the raise bit. The raise bit body includes a multiplicity of rolling cutters for contacting and disintegrating the earth formations surrounding the pilot hole. A central opening extends through said raise bit body. One end of the drive stem extends into the central opening. A pair of flats are located near the end of the drive stem. A retaining element is positioned in the flats and is bolted to the raise bit body.

SUMMARY OF THE INVENTION

The present invention provides a raise bit for enlarging a pilot hole into a larger diameter hole by disintegrating the earth formations that surround the pilot hole. The body of the bit includes a multiplicity of rolling cutters for contacting and disintegrating the formations that surround the pilot hole. A central opening extends through the bit body. One end of a drive stem extends into the central opening. A locking taper is provided on the drive stem that mates with a matching taper in the central opening. The end of the drive stem is threaded. A retaining element is provided with matching threads to allow the retaining element to draw the stem through the central opening and the locking tapers to be preloaded on the raise bit body.

The drive stem of the present invention may be removed from the bit body and a new drive stem inserted in its place. The retaining element is unthreaded from the drive stem and the drive stem is removed from the central opening in the raise bit body. A new stem may be inserted in its place and the retaining element repositioned on the bit body thereby locking the new stem to the bit body. The raise bit of the present invention may be transported through small drifts or passages by removing the drive stem. The drive stem is reattached and the raise bit is ready for operation. The high-strength, heat-treated stem is not weakened by welding. The raise bit body may be constructed from materials that are less expensive than the materials that make up the drive stem. Different size drive stems may be attached to the raise bit body to allow the raise bit to be used in pilot holes of different sizes. The removal of the stem and replacement with a new stem may be accomplished in the field under adverse conditions with simple hand tools. The above and other features and advantages of the present invention will become apparent from a consideration of the following detailed description of the invention when taken in conjunction with the accompanying drawings.

DETAILED DESCRIPTION OF THE INVENTION

Figure 1:
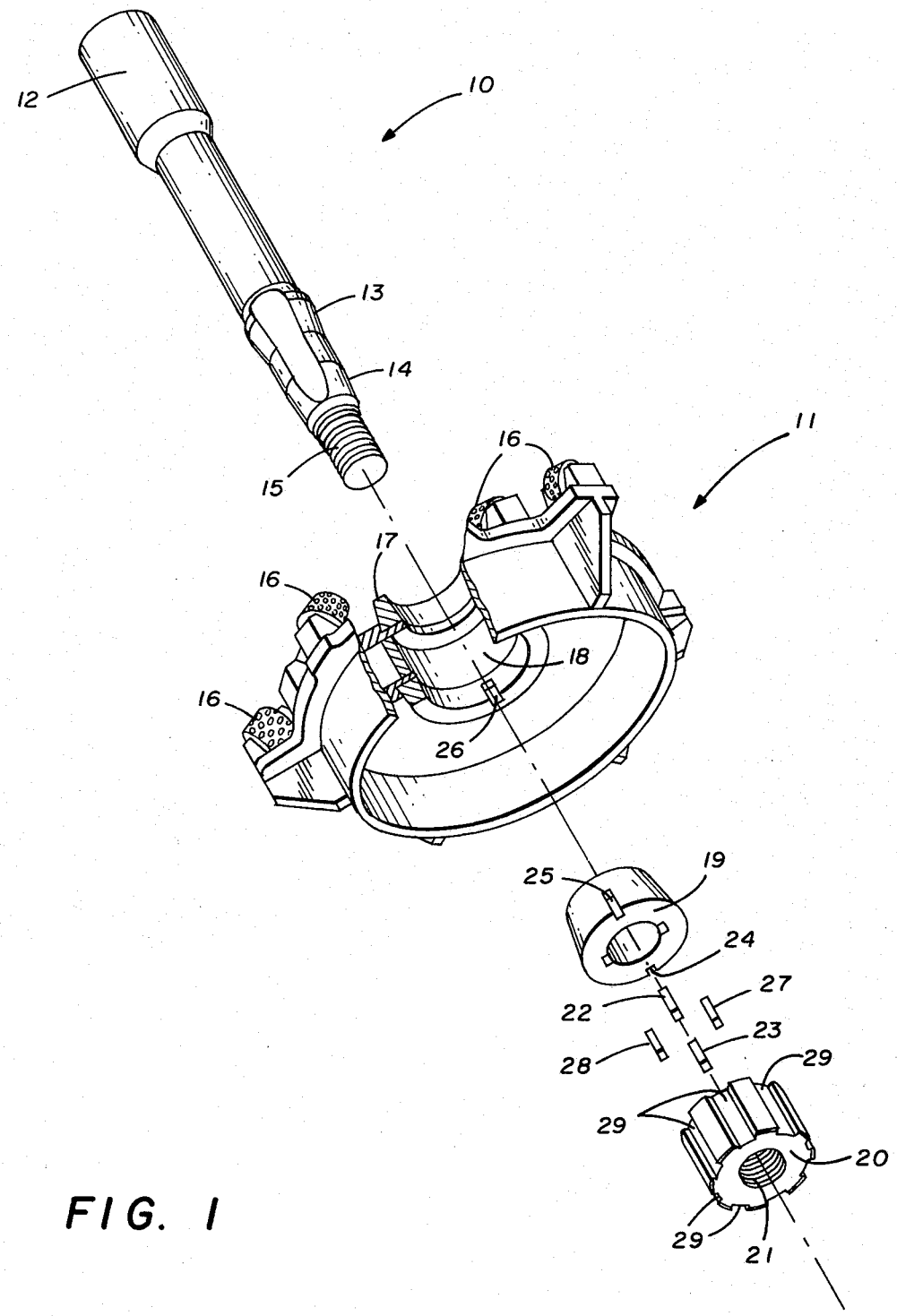
FIG. 1 is an exploded view of a bit constructed in accordance with the present invention.

Referring now to FIG. 1, an exploded view of a raise bit constructed in accordance with the present invention is shown. The raise bit includes a drive stem 10 and a raise bit body 11. The drive stem 10 is positioned to extend through a central opening in the raise bit body 11. The drive stem 10 includes an upper tapered portion 13 and a lower tapered portion 14. The lower end of the drive stem 15 is threaded with screw threads 15. The upper end of the drive stem 10 includes an attachment portion 12 to allow the raise bit to be connected to a rotary drill column (not shown).

A multiplicity of saddles are mounted on the raise bit body 11 containing a corresponding multiplicity of rolling cutters 16. The rolling cutters 16 contact and disintegrate the formations surrounding the pilot hole during the raise drilling operation. A collar 17 is positioned on the bit body 11 aligned with the central opening. The collar 17 has an inner tapered surface adapted to match the tapered portion 13 of drive stem 10. In the operative position the drive stem 10 is positioned to extend through the central opening with the tapered surface on the collar 17 mating with the tapered portion 13 of drive stem 10. The central opening includes an inverted collar with an inner tapered surface 18. A removable collar 19 is provided with an upward facing inner tapered surface that matches the tapered portion 14 of stem 10. The outside surface of the removable collar 19 is a tapered surface tapering upward that matches the inner downward tapered surface 18 on the inverted collar. In the operative position the drive stem 10 is positioned to extend through the central opening with the tapered surface on the inside of removable collar 19 mating with the tapered portion 14 of drive stem 10. A nut 20 is provided with internal threads 21. In the operative position the nut 20 is threaded onto the screw threads 15 on the lower end of drive stem 10. This draws the drive stem 10, raise bit body 11 and removable collar 19 together. Locking keys 22, 23, 27 and 28 fit within locking grooves including grooves 24, 25, 26 and 29 respectively and grooves (not shown) on the drive stem 10 to securely lock the drive stem 10 to the raise bit body 11. The tapered portions 13 and 14 of the stem 10 in combination with the matching tapers on the bit body 11 are designed to carry both torque and thrust. In addition, the tapers form a mechanical lock which also prevents radial movement of the stem with respect to the bit body.

The following example is provided to illustrate how the matching tapers carry torque, thrust and radial loads. Assume a raise bit in the range of 84 inches diameter being pulled by a raise machine with an operating torque capacity of 125,000 ft. lbs. and a thrust capacity of 600,000 lbs. The preload nut on the stem would be tightened to approximately 100,000 lbs. In theory, it would then be possible to back the nut off completely and allow all of the torque and thrust to be carried on the locking tapers.

For smaller diameter bits and/or raise machine with smaller capacities, a smaller amount of make up torque on the preload nut 20 would be required. For larger diameter bits and/or raise machines with larger capacities, the make up torque on the preload nut 20 would probably remain at 100,000 ft. lbs. The additional torque would be carried with the mechanical keys 22, 23, 27 and 28, between the friction faces of the preload nut 20 and its seat, or a combination of the two. The additional thrust would be carried in the threaded connection 15 of the stem 10 and preload nut 20.

The structural details of a raise bit constructed in accordance with the present invention having been described, a raise drilling operation will now be considered using the bit shown in FIG. 1. The raise drilling operation begins by drilling a small diameter pilot hole through the earth from a first location to an opening at a second location using a small diameter pilot bit. After the pilot hole is completed, the pilot bit is removed from the drill column and the raise bit shown in FIG. 1 is attached to the drill column. The raise bit is rotated and drawn along the pilot hole thereby enlarging the pilot hole to the desired size.

The raise bit may be transported through small drifts or passages by removing the drive stem 10 and transporting the drive stem 10 and raise bit body 11 through the small drift or passage separately. The nut 20 is disconnected from the drive stem 10. The drive stem 10 is withdrawn through the central opening in the raise bit body 11 and the drive stem 10 and raise bit body 11 are transported through the small drift or passage separately. The drive stem 10 is inserted through the central opening in the raise bit body 11. The removable collar 19 is positioned over the drive stem 10 and the nut 20 is threaded on the threaded portion 15 of drive stem 10. The drive stem 10 is again locked to the raise bit body 11 and the raise bit is ready for operation. Should the drive stem 10 experience failure prior to failure of the raise bit body 11, the drive stem may be removed from the raise bit body 11 and a new drive stem inserted in its place. If the raise bit is to be used in a pilot hole of a different size, the new drive stem may have the appropriate diameter for the new pilot hole.

The tapered portions 13 and 14 of the stem 10 and removable collar 19 are firmly seated to the tapered surfaces of the raise bit body 11 by means of the nut 20 which is screwed onto the threads 15 of the stem 10. The stem 10 is prevented from rotating with respect to the raise bit body 11 by the frictional forces developed between the tapered surfaces and/or by the combination of tapers and mechanical keys 22, 23, 27 and 28. Axial movement is prevented by the frictional force developed on the tapers and by the preload of the nut 20 on the threaded portion 15 of the drive stem 10. Previous attempts to construct a low profile raise bit have in general required that the bit be constructed in multiple stages and pieces. The present invention permits a single stage, single piece raise bit. The locking mechanism allows the stem 10 to be easily removed in the field in adverse situations with simple hand tools. The locking mechanism provides for zero clearance between the stem 10 and adjacent parts of the bit body 11, thus insuring a rigid connection. The stem 10 may be easily removed and replaced without removing the cutter saddles which are adjacent to the stem 10. Previously designed raise bit stems have generally required that the stem 10 be permanently fixed to the raise bit body 11 by welding, an undesirable method due to the fabricating procedures required. The present invention eliminates any welding to stem.

Figure 2:
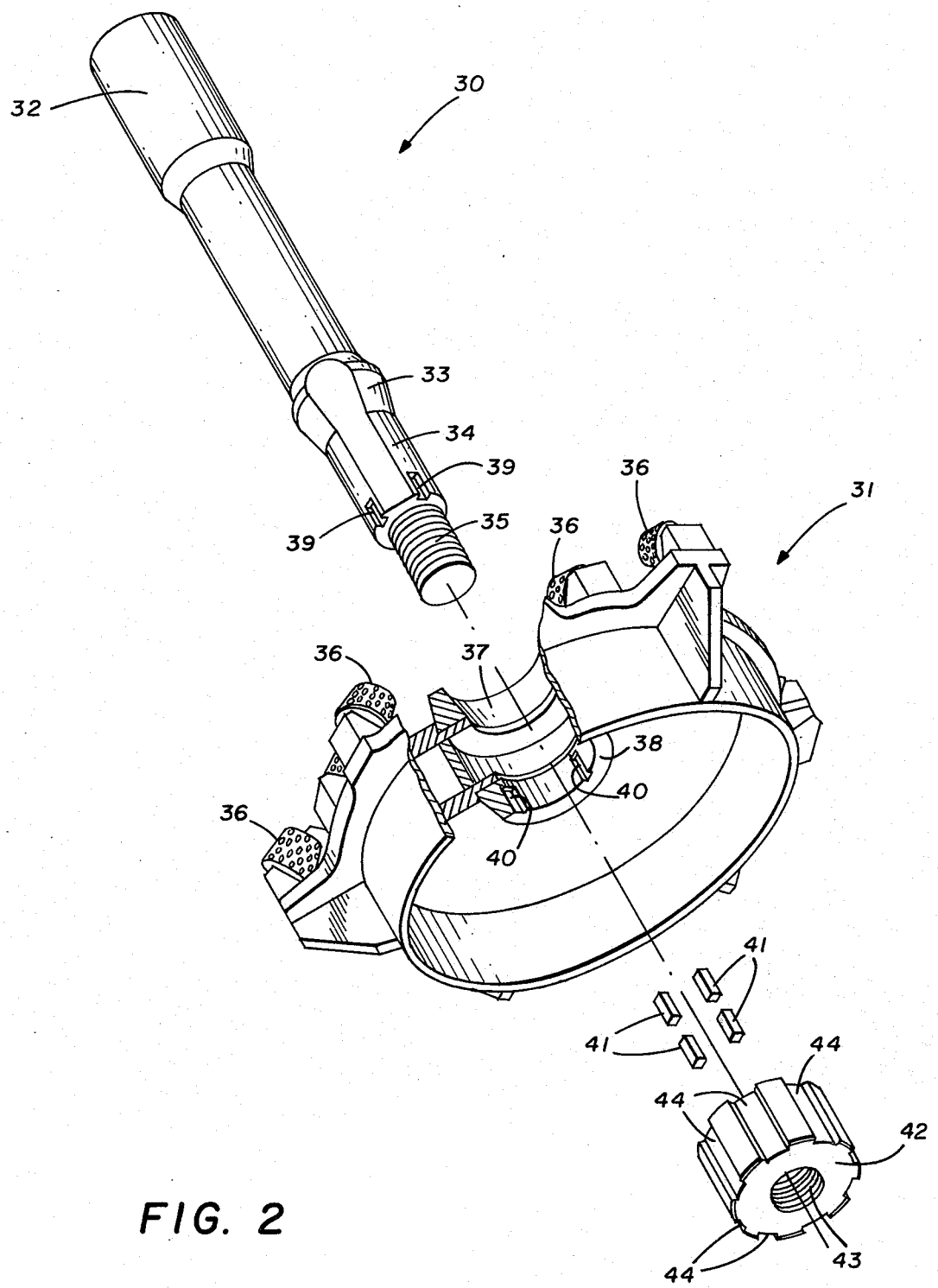
FIG. 2 is an exploded view of another embodiment of a bit constructed in accordance with the present invention.

Referring now to FIG. 2 an exploded view of another embodiment of a raise bit constructed in accordance with the present invention is shown. This embodiment includes a drive stem 30 and a raise bit body 31. The drive stem 30 is positioned to extend through a central opening in the raise bit body 31. The drive stem 30 includes a tapered portion 33 and a lower cylindrical portion 34. The lower end of the drive stem 30 is threaded with screw threads 35. The upper end of the drive stem 30 includes an attachment portion 32 to allow the raise bit to be connected to a rotary drill column (not shown). A multiplicity of keyways 39 are provided in the cylindrical portion 34 of the drive stem 30.

A multiplicity of saddles are mounted on the raise bit body 31 containing a corresponding multiplicity of rolling cutters 36. The rolling cutters 36 contact and disintegrate the formations surrounding the pilot hole during the raise drilling operation. A collar 37 is positioned on the bit body 31 aligned with the central opening. The collar 37 has an inner tapered surface adapted to match the tapered portion 33 of drive stem 30. In the operative position the drive stem 30 is positioned to extend through the central opening with the tapered surface on the collar 37 mating with the tapered portion 33 of drive stem 30. The central opening includes a collar 38 with a multiplicity of keyways 40. A nut 42 is provided with internal threads 43. In the operative position the nut 42 is threaded onto the screw threads 35 on the lower end of drive stem 30. This draws the drive stem 30 into the central opening in raise bit body 31 forcing the tapered surface of collar 37 and the tapered portion 33 of drive stem 30 together. Locking keys 41 are positioned in the keyways 39 and 40 and in the grooves 44 on the nut 42. This secures the nut 42 in place and locks the drive stem 30 to the raise bit body 31. The tapered portion 33 of the stem 30 in combination with taper 37 is designed to carry both torque and thrust. In addition, the tapers form a mechanical lock which also prevents radial movement of the stem with respect to the bit body.

The structural details of a raise bit constructed in accordance with the present invention having been described, a raise drilling operation will now be considered using the bit shown in FIG. 2. The raise drilling operation begins by drilling a small diameter pilot hole through the earth from a first location to an opening at a second location using a small diameter pilot bit. After the pilot hole is completed, the pilot bit is removed from the drill column and the raise bit shown in FIG. 2 is attached to the drill column. The raise bit is rotated and drawn along the pilot hole thereby enlarging the pilot hole to the desired size.

The raise bit may be transported through small drifts or passages by removing the drive stem 30 and transporting the drive stem 30 and raise bit body 31 through the small drift or passage separately. The keys 41 are removed. The nut 42 is disconnected from the drive stem 30. The drive stem 30 withdrawn through the central opening in the raise bit body 31 and the drive stem 30 and raise bit body 31 are transported through the small drift or passage separately. The drive stem 30 is reinserted through the central opening in the raise bit body 31. The nut 42 is threaded onto the threaded portion 35 of drive stem 30. The keys 41 are inserted in place and the drive stem is again locked to the raise bit body 31 and the raise bit is ready for operation. Should the drive stem 30 experience failure prior to failure of the raise bit body 31 the drive stem may be removed and a new drive stem inserted in its place. If the raise bit is to be used in the pilot hole of a different size, the new drive stem may have the appropriate diameter for the new pilot hole. The taper 33 of the stem 30 is firmly seated to the taper of collar 37. The drive stem 30 is prevented from rotating with respect to the raise bit body 31 by the frictional forces developed between the tapers and the frictional forces developed between the nut 42 and collar 38. Axial movement is prevented by the frictional forces developed on the tapers and by the preload of the nut 42 on the threaded portion 35 of drive stem 30.

The embodiments of the invention in which an exclusive property or privilege is claimed are defined as follows:

1. A raise bit for enlarging a pilot hole into a larger diameter hole by disintegrating earth formations surrounding the pilot hole, comprising:

a cutter stage body, said cutter stage body having an upper portion and a lower portion;

a multiplicity of saddles mounted on said upper portion of said cutter stage body;

a multiplicity of rolling cutters positioned in said saddles;

a central opening in said cutter stage body, said central opening having a tapered inner surface tapering outward toward said upper portion of said cutter stage body;

a drive stem positioned in said central opening;

a tapered surface on said drive stem that matches said tapered inner surface in said central opening, said tapered surface on said drive stem mating with said tapered inner surface of said central opening in said cutter stage body; and means for urging said drive stem into said central opening.

2. A bit for enlarging a pilot hole into a larger diameter hole by disintegrating earth formations surrounding the pilot hole, comprising:

a drive stem having an upper end for projecting into said pilot hole and a lower end;

a threaded connection on the lower end of said drive stem;

a tapered portion on said drive stem between said upper end and said lower end;

a main bit body including a multiplicity of cutters for contacting and disintegrating earth formations surrounding the pilot hole;

a hole extending through said main bit body;

a tapered surface in said hole that matches said tapered portion on said drive stem, said tapered surface in said hole mating with said tapered portion on said drive stem; and a nut adapted to be connected to said threaded connection on the lower end of said drive stem for locking said drive stem on said main bit body.

3. A raise bit for enlarging a pilot hole into a larger diameter hole by disintegrating earth formations surrounding the pilot hole, comprising:

a drive stem having an upper end for projecting into said pilot hole and a lower end;

a threaded connection on said drive stem;

a cutter stage body;

a multiplicity of saddles mounted on said cutter stage body;

a multiplicity of rolling cutters positioned in said saddles;

a hole extending through said cutter stage body;

a taper surface in said hole;

said drive stem adapted to be positioned in said hole, said drive stem having a tapered portion that mates with said taper surface in said hole; and a nut adapted to be connected to said threaded connection on said drive stem to lock said cutter stage body on said drive stem.

* * * * *